US005500806A

United States Patent [19]

Bellin et al.

[11] Patent Number: 5,500,806

[45] Date of Patent: Mar. 19, 1996

[54] DATA LOGGING IN A VOLTAGE REGULATOR CONTROLLER

[75] Inventors: Michael A. Bellin, Brandon, Miss.; Carl Laplace, Raleigh, N.C.; John J. Trainor, Wake Forest, N.C.; Mark Hoffmann, Chapel Hill, N.C.

[73] Assignee: Siemens Energy & Automation, Inc., Alpharetta, Ga.

[21] Appl. No.: 154,315

[22] Filed: Nov. 18, 1993

[51] Int. Cl.[6] ..... G06G 7/63; G05F 1/14

[52] U.S. Cl. ..... 364/492; 364/551.01; 364/554; 324/416; 323/255

[58] Field of Search ..... 364/483, 492, 364/493, 550, 551.01, 554; 323/255, 258; 324/416

[56] References Cited

U.S. PATENT DOCUMENTS

| | | | |
|---|---|---|---|
| 4,363,101 | 12/1982 | Czerniejewski | 364/483 |
| 4,368,519 | 1/1983 | Kennedy | 364/483 |
| 4,400,783 | 8/1983 | Locke, Jr. et al. | 364/483 |
| 4,419,619 | 12/1983 | Jindrick et al. | 364/483 |
| 4,535,409 | 8/1985 | Jindrick et al. | 364/483 |
| 4,630,220 | 12/1986 | Peckingpaugh | 364/483 |
| 4,910,692 | 3/1990 | Outram et al. | 364/550 |
| 5,301,122 | 4/1994 | Halpern | 364/483 |
| 5,335,135 | 8/1994 | Kinney | 324/142 |

*Primary Examiner*—Emanuel T. Voeltz
*Assistant Examiner*—Kyle J. Choi
*Attorney, Agent, or Firm*—Peter A. Luccarelli, Jr.

[57] ABSTRACT

A voltage regulator controller including three types of data logs which are operator selectable and configurable. An operator can enable data logging to occur at specific times and intervals. The voltage regulator controller includes a real time clock/calendar and interval timer to support this function. In a preferred embodiment, the controller includes an event log, a snapshot interval log and a minimum/maximum metered parameter log. Advantageously, the event log can be programmed to monitor configuration changes made from the voltage regulator controller's front panel or from a remote device. The voltage regulator controller also includes a memory card interface which enables the log contents to be uploaded to a removable PCMCIA standard memory card.

19 Claims, 4 Drawing Sheets

DATA LOGGING IN A VOLTAGE REGULATOR CONTROLLER

I. Cross Reference to Related Applications

This application is related to U.S. patent application Ser. No. 07/950,402; filed on Sep. 23, 1992; and U.S. patent application Ser. No. 08/101,133; filed on Aug. 2, 1993 now U.S. Pat. No. 5,455,505.

II. Background of the Invention a. Field of the Invention

This invention relates to voltage regulators and related control systems.

b. Related Art

A step-type voltage regulator is a device which is used to maintain a relatively constant voltage level in a power distribution system. Without such a regulator, the voltage level of the power distribution system could fluctuate significantly and cause damage to electrically powered equipment.

A step-type voltage regulator can be thought of as having two parts: a transformer assembly and a controller. A conventional step-type voltage regulator transformer assembly 102 and its associated controller 106 are shown in FIG. 1. The voltage regulator transformer assembly can be, for example, a Siemens JFR series. The windings and other internal components that form the transformer assembly 102 are mounted in an oil filled tank 108. A tap changing mechanism (not shown) is commonly sealed in a separate chamber in the tank 108.

The various electrical signals generated by the transformer are brought out to a terminal block 110 and external bushings S, SL, L for access. The terminal block is preferably covered with a waterproof housing. An indicator 112 is provided so that the position of the tap as well as its minimum and maximum positions can be readily determined.

A cabinet 114 is secured to the tank to mount and protect the voltage regulator controller 106. The cabinet 114 includes a door (not shown) and is sealed in a manner sufficient to protect the voltage regulator controller 106 from the elements. Signals carried between the transformer or tap changing mechanism and the voltage regulator controller 106 are carried via an external conduit 116.

The tap changing mechanism is controlled by the voltage regulator controller 106 based on the controller's program code and programmed configuration parameters. In operation, high voltage signals generated by the transformer assembly 102 are scaled down for reading by the controller 106. These signals are used by the controller 106 to make tap change control decisions in accordance with the configuration parameters and to provide indications of various conditions to an operator.

SUMMARY OF THE INVENTION

In accordance with an embodiment of the present invention, a voltage regulator controller is provided with a log memory and control software for storing and maintaining data logs which are operator selectable and configurable. An operator can enable data logging to occur upon the occurrence of one or more predefined events and at specific times and intervals.

According to one aspect of the present invention, a voltage regulator controller includes an interface which couples the voltage regulator controller to a regulator transformer; a processor for monitoring electrical parameters present in the regulator transformer and for providing control signals to the regulator transformer responsive to at least one of the electrical parameters; an operator interface for receiving configuration data from an operator of the voltage regulator controller; a log memory; and a log task for capturing, in the log memory, data indicative of at least some of the electrical parameters when conditions specified by the configuration data occur.

According to another aspect of the present invention a method of operating a voltage regulator controller includes the steps of receiving configuration data including information indicative of a log triggering condition, from an operator of the voltage regulator controller; monitoring the voltage regulator controller and a regulator transformer whose operation is controlled by the voltage regulator controller, for occurrence of the log triggering condition; monitoring electrical parameters present in the regulator transformer; and, capturing data indicative of at least some of the electrical parameters in a memory when the log triggering condition is detected.

III. BRIEF DESCRIPTION OF THE DRAWINGS

Like reference numerals appearing in more than one figure represent like elements.

IV. DETAILED DESCRIPTION OF THE PREFERRED EMBODIMENT

An embodiment of the present invention will now be described by reference to FIGS. 2 through 4.

Figure 3:
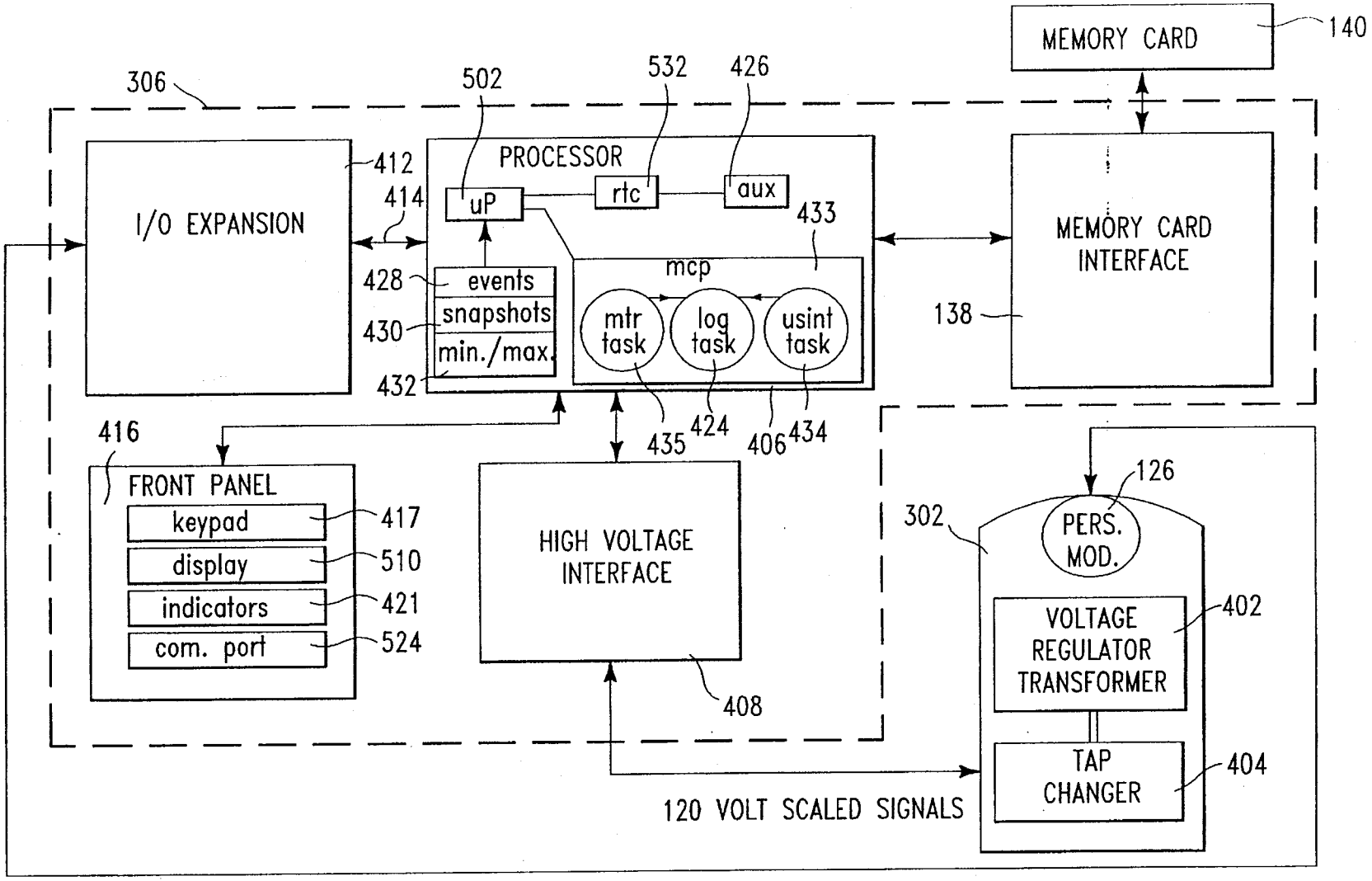
FIG. 3 is a block diagram of a voltage regulator controller in accordance with an embodiment of the present invention; and, FIG. 4 is a more detailed diagram of the processor board of FIG. 3 showing its interconnection to other components of the voltage regulator controller.

A step-type voltage regulator and its associated controller according to an embodiment of the present invention are shown in FIG. 3. The voltage regulator transformer assembly 302 can be, for example, a Siemens JFR series but in any event is of a conventional type which includes a multi-tap transformer 402 and an associated tap changer 404. The tap changer 404 is controlled by the voltage regulator controller 306 which receives signals indicative of voltage and current in the windings of the transformer 402 and conventionally generates tap control signals in accordance with operator programmed set-points and thresholds for these signals. The voltage regulator 302 can also be provided with a personality module 126 which stores statistics and historical information relating to the voltage regulator.

The voltage regulator controller 306 includes a processor section 406, a high voltage interface 408, a memory card interface 138 (which can be of the PCMCIA type), an I/O expansion chassis 412 which is coupled to the processor section 406 by way of an SPI bus 414 and a front panel 416 which is coupled to the processor section.

The front panel 416 provides an operator interface including a keypad 417, a character display 510, indicators 421 for various regulator conditions and a serial communications port connector 524. A user interface task ("usint") 434 running under the mcp monitors activity on the keypad 417 and provides responses to the character display 510 as needed. The front panel 416, its associated operator interface and the user interface task 434 can be of the type described in United States patent application Ser. No. 07/950,402; filed on Sep. 23, 1992, which is incorporated by reference in its entirety as if printed in full below.

The processor section 406 is controlled by a microprocessor (uP) 502. The processor section 406 generates digital control signals based on internal program code and operator selected parameters entered (by an operator) via the controllers front panel 416. In operation, high voltage signals are generated by the voltage regulator transformer 402. These signals are scaled down via internal transformers (not shown) and provided to the high voltage interface 408. The high voltage interface 408, in turn, further scales the transformed down signals for reading by an analog to digital converter 502*c* (shown in FIG. 4) within the processor section 406. The data fed back from the voltage regulator 402 is used by the processor section 406 to make tap change control decisions and to provide indication of various conditions to an operator.

The memory card interface 138 is disposed in the controller housing so that it is externally accessible via a slot formed in the controller housing wall. A voltage regulator controller having a suitable memory card interface is described, for example, in copending U.S. patent application Ser. No. 08/101,133; filed on Aug. 2, 1993 now U.S. Pat. No. 5,455,505, which is incorporated by reference in its entirety as if printed in full below.

In accordance with an embodiment of the present invention, the processor section 406 includes a log memory 422 and control software (log task) 424 for storing and maintaining data logs which are operator selectable and configurable. An operator can enable data logging to occur at specific times and intervals as will be described in more detail later. The processor section 406 also includes an internal real time clock, calendar and interval timer (collectively referred to as the rtc 532) to support this function. The real time clock/calendar is supported with a conventional self-recharging auxiliary power source back-up 426. The auxiliary power source 426 is rated so that time is kept for a suitable minimum outage period, for example 72 hours.

There are three data logs which are stored and maintained in the log memory 422. These include an event log 428, a snapshot/interval log 430 and a minimum/maximum (min/max) log 432.

The event log 428 stores present readings when an event occurs. Events which will trigger the event logging function are defined in log set-up configuration items entered via the keypad 417. Events which can be specified to trigger event logging (trigger events) include controller power up; parameter (setting) changes (entered, for example, by way of the front panel or a communications port); alert conditions such as high voltage or low current. Voltage Reduction Control (VRC) operations; Voltage Limit Control (VLC) operations; the reaching of operator-specified, pre-defined tap positions and power flow direction changes. Those of skill in the art will recognize that other events, such as relay conditions as status input changes, could be monitored as well. Entries stored in the event log 428 can be retrieved via the display 510 or via a communications port such as the front panel serial communications port 524. Optionally, events can be time/data stamped by using the real time clock/calendar 532.

The snapshot/interval log 430 stores present readings at specific times and or intervals which are defined in the configuration settings. Entries stored in the snapshot/interval log 430 can be retrieved via the display 510 or via a communications port (e.g. 524). As will be described in more detail later, the snapshot/interval log is used in conjunction with the real time clock/calendar 532.

The min/max log 432 stores minimum and maximum values for metered parameters. These parameters can be viewed via the display 510 under keypad control and/or can be communicated via a communications port. Once interrogated, the min/max values are resetable one at a time. The displayed value reverts to the present value upon reset and integration is restarted. Optionally, the minimum and/or maximum values for any metered parameter can be time/date stamped using the real time clock/calendar 532.

The log task 424 is a software task which runs under the microprocessor's main control program (mcp) 433. One function of the log task 424 monitors the voltage regulator controller and transformer assembly for the operator specified event conditions (e.g. by monitoring signals coming from the high voltage interface 408). When the log task 424 detects occurrence of an operator specified trigger event, it captures the parametric data for that event in the event log 428.

An operator activates event logging by depressing a unique key sequence on the keypad 417. When event logging is activated, the log task 424 performs the activities required to detect occurrence of the trigger event. Log task activities include: 1) tracking tap position, 2) monitoring conditions for VLC and imposing VLC when conditions warrant, 3) monitoring conditions for VRC and imposing VRC when conditions warrant, 4) monitoring power flow direction, 5) determining occurrence of power up, 6) determining when configuration changes are made and 7) determining when alert conditions occur.

Each entry in the event log includes a code which identifies the cause of the event (e.g. tap change, power up, specified configuration change, etc.); the event number (e.g identification of the logged entry as the first, second, third . . . event to occur since event logging was commenced); parametric data associated with an event such as instantaneous values for the load voltage, load current, power factor, real power, reactive power, apparent power, source voltage and the instantaneous tap position; and a time/data stamp from the rtc. The parametric data are updated periodically by a metering task 435 running under the main control program 433.

The operator enables data logging by configuring the voltage regulator controller 306 via the front panel 416. The operator enters configuration data via the keypad 417 while viewing the configuration data on the display 510. When the operator changes the configuration data (e.g. event log set-up), the user interface task 434 modifies the corresponding configuration data. This revised configuration data is then accessible by the log task 424 (e.g. for determining which events to record in the event log 428).

According to an embodiment of the present invention, the event log definitions can be set up so that future configuration changes made by an operator are time and date stamped and recorded in the event log 428. When this option is invoked by an operator (via a keystroke sequence on the keypad) the operator interface task 434 notifies the log task 424 about the occurrence and type of any operator programmed configuration changes. The log task 424, in turn, adds a time and date stamp to the configuration change data (using the rtc 532) and stores the time/date stamped configuration change information in the event log 428.

The snapshot/interval log 430 operates under a similar principle, storing snapshots of operator specified data at operator specified times (the data and time specifications all being passed through to the log task 424 by the operator interface task 434). Once the operator sets the interval period and enables interval logging via the operator interface, the log task begins timing the specified interval using the rtc. When the interval time has elapsed (or the snapshot time/date has occurred), values of the parametric working data are stored in the snapshot/interval log 428 and the log task starts timing out the next interval.

Each entry in the snapshot/interval log 430 includes the interval number; the time and date of the interval snapshot; the minimum, maximum, instantaneous and demand values for the load voltage, load current, real power, reactive power and apparent power; the instantaneous power factor; the power factor at minimum and maximum apparent power; the instantaneous minimum and maximum tap position; and the total operations count. Many other combinations of interval parameter storage could also be performed if desired.

Log data for both intervals and events can be accessed by way of the display 510 (under control of the keypad 417) or remotely via a communications port. Similarly, the log set-up information can be configured remotely via a communications port.

The log task 424 monitors the values of metered parameters and compares the new values to previously stored minimum and maximum values. If a new value for a metered parameter falls below the stored minimum value, then the new value is stored as the new minimum value. Similarly, if a new value for a metered parameter rises above the stored maximum value, the new value is stored as the new maximum value. The operator can individually clear each stored minimum and maximum value by selecting the minimum or maximum value for display and then pressing the reset key on the front panel keypad.

The log task 424 maintains the minimum/maximum data in the min/max log 432. The working parameters (the instantaneous metered values) are periodically updated by the metering task 435. The log task compares the minimum and maximum log data to the working parameters and updates the min./max. log entries as required.

Minimum/Maximum logging is essentially always enabled when the voltage regulator controller is turned on.

The operator can view the min/max log data via the display 510 under control of the keypad 417. Using the keypad, the operator first displays the instantaneous value for the parameter of interest. Then by pressing a Max/Min key, the operator can view either the minimum or the maximum value for the parameter. Through further key press sequences, the operator can also view the time and date of occurrence for each minimum or maximum value.

Min/Max log data as well as the time and data of their occurrence can be accessed remotely via a communications port.

Any or all of the logs 428, 430, 432 can be uploaded to a memory card 140 by way of the memory card interface 138. This is accomplished by an operator plugging a PCMCIA standard memory card into the memory card interface and invoking an "UPLOAD" command from the keypad 417. When the UPLOAD command is invoked, the microprocessor causes the memory card interface to assert a write enable signal to the memory card and copies the contents of the logs 428,430, 432 to the memory card 140 via the memory card interface 138.

Figure 1:
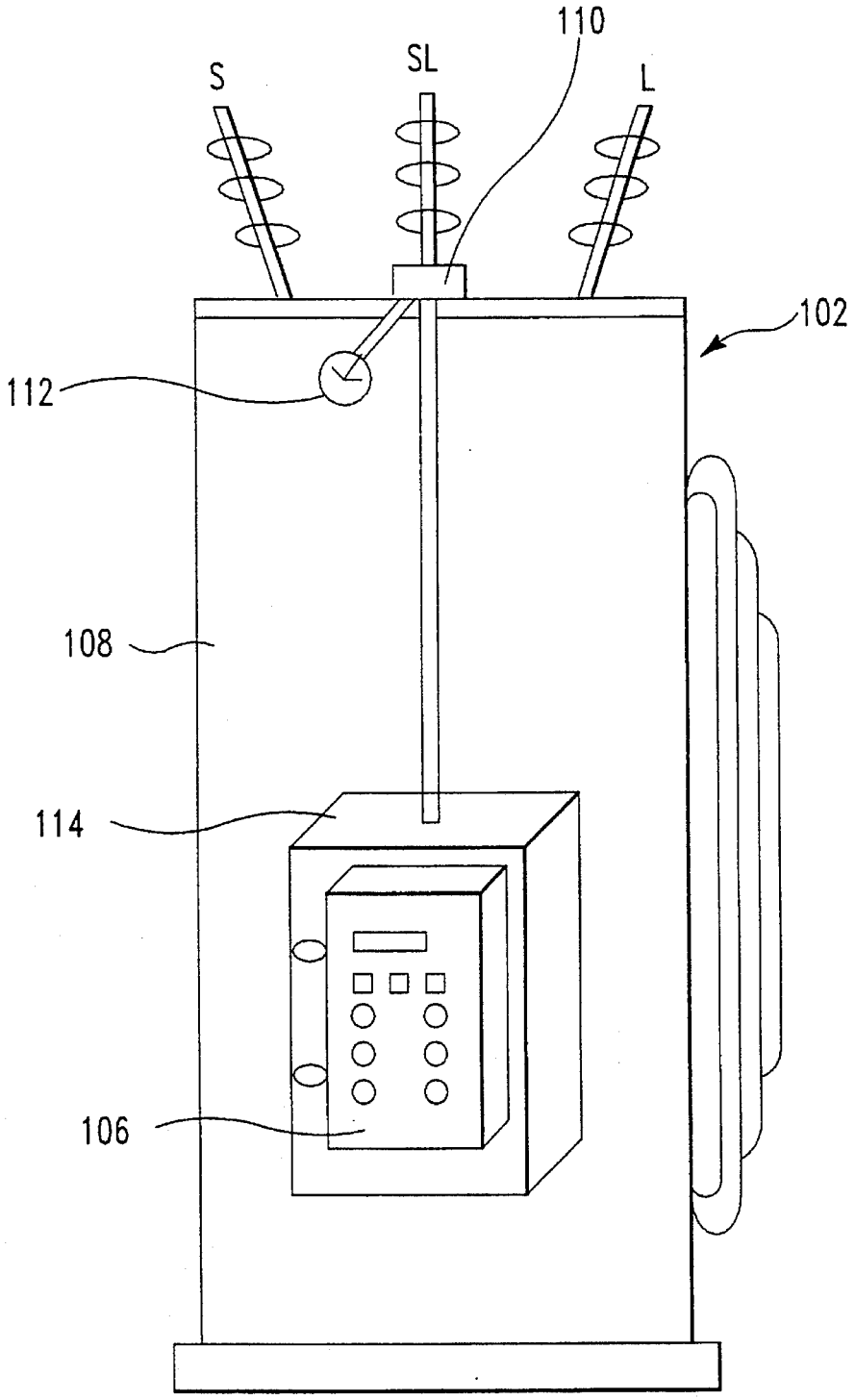
(PRIOR ART) FIG. 1
FIG. 1 shows a conventional voltage regulator transformer assembly and controller.
Figure 2:
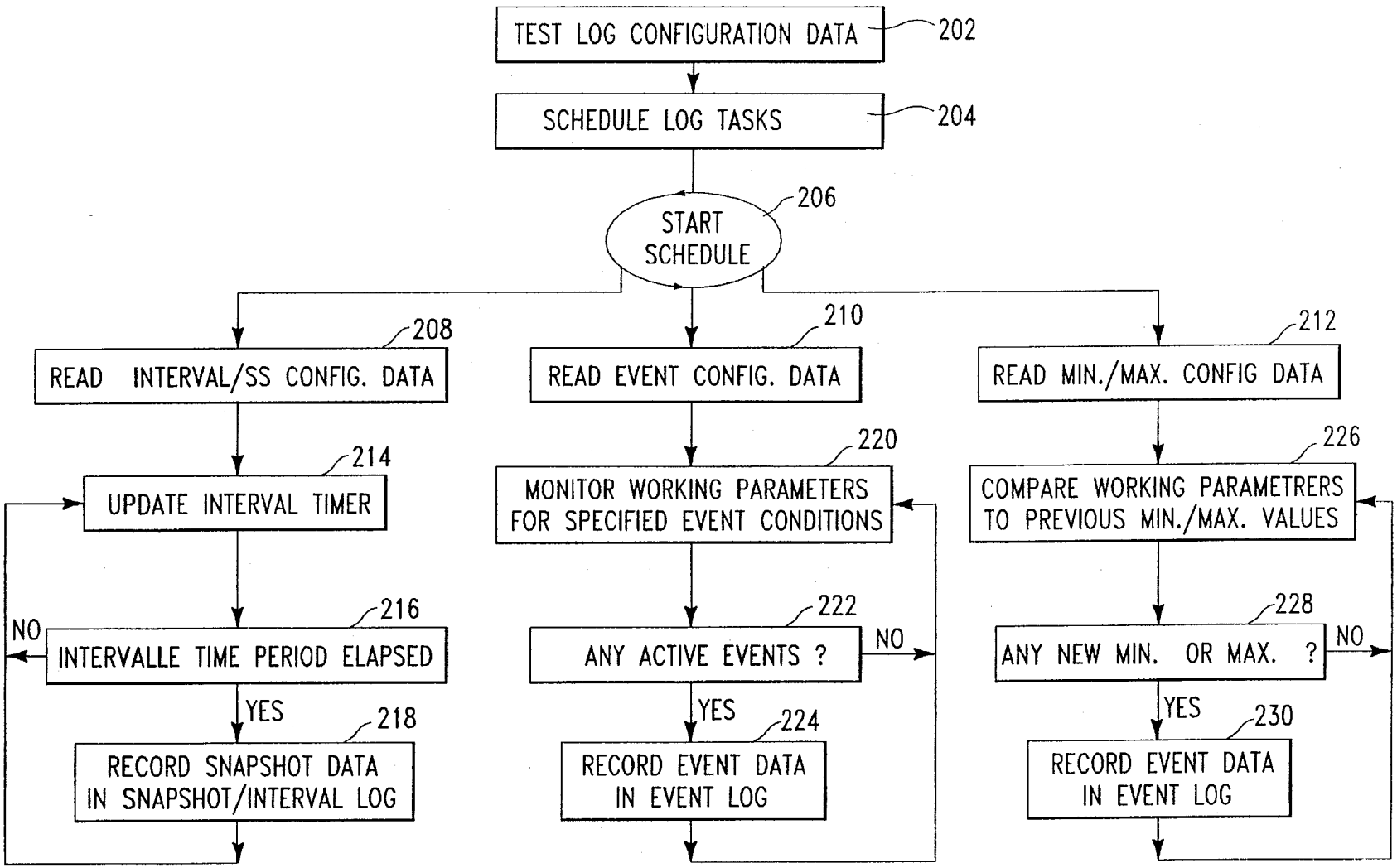
FIG. 2 is a flow chart of data logging in a voltage regulator controller according to an embodiment of the present invention.

The operation and scheduling of the various data logging functions are shown in FIG. 2. As explained previously, data logging is enabled by an operating setting the appropriate configuration parameters by way of the front panel or via a communications port. The user interface task 434 stores these parameters in the processor's memory where they are available to the mcp 433 and the log task 424. The configuration parameters specify which logging functions are to be enabled. In step 202 these parameters are read by the mcp 433 which, in turn, in step 204 schedules program tasks for each of the enabled logging functions. The scheduler (step 206) ensures that each of the enabled logging functions is executed by the microprocessor 502 using conventional time-sharing algorithms.

Each of the logging functions starts (in steps 208–212) by reading its associated configuration parameters as specified by the operator and stored by the operator interface task 434.

For the snapshot/interval log, the associated configuration data includes the operator specified interval and can optionally include data indicative of which working parameters to store in the snapshot log when the specified interval has elapsed. Alternatively, the working parameters to be captured can be a fixed set specified by the log task's programming code. In any event, in step 214 the snapshot log program code updates the interval timer. During the first pass, this includes programming the interval timer with the initial interval. During subsequent passes, this includes modifying the specified interval and reinitializing the timer when the specified interval has been changed by the configuration data. In step 216, the snapshot log program code checks the interval timer to determined if the interval has expired. If so, in step 218 the program code records the specified snapshot data and restarts the interval timer in step 214. If no, the program code again updates the interval timer as needed in step 214.

Similar to the snapshot/interval log, the event configuration data specifies one or more triggering events and can optionally specify the working parameters to be captured in the event log when the specified events occur. Alternatively the working parameters can be fixed by the log task program code as described for the snapshot/interval log. The event configuration data also includes an indicator as to whether the occurrence of the specified triggering events are to be time stamped.

In step 220 the event log program code commences monitoring the working parameters used to determine occurrence of the event triggers specified by the event conditions. If any of the event triggers occur, this is detected in step 222 and the event data is recorded in step 224. The monitoring of step 220 continues throughout the process.

Unlike snapshot and event logging, the processor tracks new minimum and maximums of metered parameters whether the logging function is enabled or not. However, when the min/max log is enabled all new occurrences of minimums and maximums specified by the configuration parameters are time stamped and stored in the minimum/maximum log. In step 226, the min/max program compares the working parameters to their previously stored minimum and maximum values. If any new minimums or maximums are detected in step 228, they are time stamped and recorded in the event log in step 230.

The present invention may be embodied as an improvement to the base circuitry and programming of an existing microprocessor based voltage regulator controller. An example of a controller having suitable base circuitry and programming is the Siemens MJX voltage regulator controller, available from Siemens Energy and Automation, Inc. of Jackson, Miss.

Figure 4:
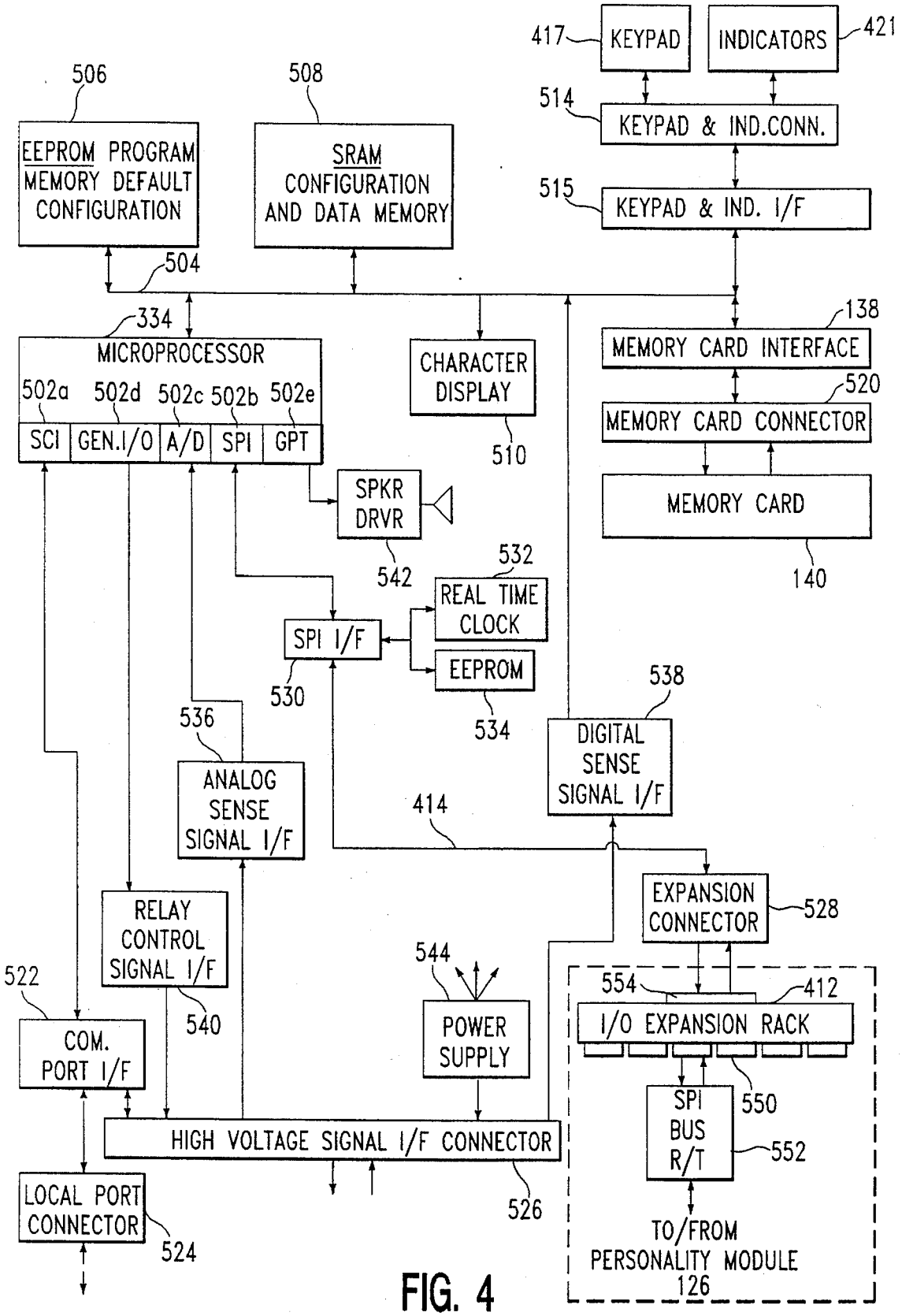

A more detailed block diagram of the processor section 406 and its interconnection other elements of the voltage regulator controller is illustrated in FIG. 4.

The processor section 406 includes the microprocessor 502 (for example, a Motorola 68HC16) which is coupled to the other processor elements by way of a common bus 504. An electrically erasable programmable read only memory (EEPROM) 506 includes the microprocessor's program instructions (including the mcp 433, the user interface task 434, the metering task 435 and the log task 424) and default configuration data.

A static type random access memory (SRAM) 508 stores operator programmed configuration data and includes an area for the microprocessor 502 to store working data. The SRAM also include a memory space for the data logs 428–432.

The microprocessor 502 also communicates with the alphanumeric character display 510, the keypad 417 and indicators 421 and the memory card interface 138 via the bus 504.

The keypad 417 and indicators 421 are coupled to the bus 504 via a connector 514 and a bus interface 515. As previously described, a memory card 140 can be coupled to the bus 504 by way of a conventional PCMCIA standard interface 138 and connector 520.

Operational parameters, setpoints and special functions including metered parameters, log enables, log configuration data and local operator interfacing are accessed via the keypad 512. The keypad is preferably of the membrane type however any suitable switching device can be used. The keypad provides single keystroke access to regularly used functions, plus quick access (via a menu arrangement) to all of the remaining functions.

The microprocessor 502 includes an SCI port 502*a* which is connected to a communication port interface 522.

The communication port interface 522 provides the SCI signals to the external local port 524 on the controller's front panel 416. An isolated power supply for the communication port interface 522 is provided by the high voltage interface 408 via high voltage signal interface connector 526.

The communication port interface 522 supports transfer of data in both directions, allowing the controller to be configured via a serial link, and also provides meter and status information to a connected device. In addition to supporting the configuration and data retrieval functions required for remote access, the communication port interface 522 supports uploading and/or downloading of the program code for the microprocessor 502.

The communication port interface 522 can be, for example, an RS-232 compatible port. The local port connector 524 can be used for serial communication with other apparatus, for example a palmtop or other computer. The physical interface of the local port connectors 524 can be a conventional 9-pin D-type connector whose pin-out meets any suitable industry standard.

The microprocessor 502 also includes a SPI port 502b which is connected to an expansion connector 528 by way of an SPI interface 530. The expansion connector brings the SPI bus 414 out to the I/O expansion chassis 412 via a cable. Other devices that reside on the SPI bus include the real time clock 532 and a serial EEPROM 534. The real time clock provides the time and date stamp data and the interval data for the log task 424. The serial EEPROM 534 stores operator programmed configuration data. The operator programmed configuration data is downloaded to the SRAM 532 by the microprocessor 502 when the processor section 406 is initialized. The SRAM copy is used, by the microprocessor, as the working copy of the configuration data. The real time clock 532 is programmed and read by the microprocessor 502.

The high voltage signal interface connector 526 provides a mating connection with a connector on the high voltage interface 408. Scaled analog signals from the high voltage interface 408 are provided to an A/D converter port 502*c* by way of an analog sense signal interface 536. The analog sense signal interface 536 low pass filters the scaled analog input signals prior to their provision to the A/D converter port 502*c*. Digital signals from the high voltage interface 408 are provided to the bus 504 via a digital sense signal interface 538. The digital sense signal interface 538 provides the proper timing, control and electrical signal levels for the data.

Control signals from the microprocessor's general I/O port 502*d* are provided to the high voltage signal interface connector 526 by way of a relay control signal interface 540. The relay control signal interface converts the voltage levels of the I/O control signals to those used by the high voltage interface 408. A speaker driver 542 is connected to the GPT port 502*e* of the microprocessor 502. The processor section 406 also includes a power supply 544 which provides regulated power to each of the circuit elements of the processor board 406 as needed. The high voltage interface 408 provides an unregulated power supply and the main 5 volt power supply for the processor board 406.

The microprocessor 502 recognizes that a memory card 140 has been plugged into the memory card interface 518 by monitoring the bus 504 for a signal so indicating. In response, the microprocessor 502 reads operator selected control parameters entered via the controller's keypad 417. Depending on the control parameters, the microprocessor either updates the programming code in its configuration EEPROM 506, executes the code from the memory card 140 while it is present but does not update its EEPROM 506, or dumps selected status information to the memory card 140 so that it can be analyzed at a different location. As an alternative embodiment, the processor section 406 can be programmed to default to the memory card program when the presence of a memory card is detected. In this case, upon detection, the program code from the memory card would be downloaded to the SRAM 508 and executed by the microprocessor from there.

The I/O expansion chassis (rack) 412 includes a number (e.g. 6) of connectors 550 for receiving field installable, plug-in I/O modules 552. The connectors 550 are electrically connected to the SPI bus 414 via a common processor section interface connector 554 and couple the I/O module(s) 552 to the SPI bus 414 when they are plugged into the chassis.

The processor section can communicate with the personality module 126 in a number of ways. For example, the microprocessor 502 can be provided with conventional RS-232 interface circuitry to the SCI bus or the data bus. A conventional RS-232 cable can then be used to connect this RS-232 interface to an RS-232 interface on the personality module. Alternatively, an I/O module (SPI BUS R/T) in the I/O expansion chassis can provide the physical and electrical interface between the SPI bus 414 and a cable connected to the personality module. An SPI R/T can also be used to provide outside access to the data logs 422 and associated configuration parameters.

Now that the invention has been described by way of the preferred embodiment, various modifications, enhancements and improvements which do not depart from the scope and spirit of the invention will become apparent to those of skill in the art. Thus, it should be understood that the preferred embodiment has been provided by way of example and not by way of limitation. The scope of the invention is defined by the appended claims.

We claim:

1. A voltage regulator controller for an electrical power distribution system, comprising:

interface means for coupling the voltage regulator controller to a regulator transformer;

processor means, coupled to the interface means, for monitoring electrical parameters present in said regulator transformer and for providing control signals to the regulator transformer responsive to at least one of the electrical parameters;

operator interface means, coupled to the processor means, for receiving operator selected configuration data selected by an operator of the voltage regulator controller, the operator selected data including time interval data representative of a time interval, and parameter data representative of at least one electrical parameter;

a log memory coupled to the processor means; and, log task means, coupled to the operator interface means, said processor means and said log memory, said log means including:

(a) means for capturing, in the log memory, information indicative of at least a subset of the electrical parameters in the memory when an event specified by the operator selected configuration data occurs;

(b) means for capturing, in the log memory, the information indicative of the subset of the electrical parameters when the time interval represented by the time interval data has elapsed; and, (c) means for capturing minimum and maximum values of the at least one of the electrical parameters represented by the parameter data along with time data indicative of the times the minimum and maximum values of the electrical parameters occurred.

2. The apparatus of claim 1, further comprising: a memory card interface coupled to the log memory and wherein the processor means includes means for uploading log data stored in the log memory to a removable memory card.

3. The apparatus of claim 1 wherein the log task means comprises means for monitoring changes to the configuration data made by the operator and for capturing information indicative of the changes in the memory along with a time stamp indicative of when the changes were made.

4. A method of operating a voltage regulator controller of a type used to control a step-type regulator having an internal multi-tap transformer, comprising the steps of:

(a) receiving configuration data selected by an operator of the voltage regulator controller, the configuration data including specifications of log triggering conditions, wherein the log triggering conditions include:

(i) occurrence of an event relating to regulator control; and (ii) elapse of a recurring time interval;

(b) monitoring the voltage regulator controller and the voltage regulator transformer for occurrence of the log triggering condition;

(c) monitoring electrical parameters present in the regulator transformer; and, (d) capturing data indicative of at least some of the electrical parameters in a memory when the log triggering condition is detected.

5. The method of claim 4 wherein data indicative of the log triggering condition in step (a) is stored in the memory along with the electrical parameters in step (d).

6. The method of claim 4 wherein the event receivable in step (a) as the log triggering condition includes occurrence of a tap change in the regulator transformer.

7. The method of claim 4 further comprising the step of: uploading log data stored in the memory to a removable memory card.

8. The apparatus of claim 4 wherein the data stored in the memory include minimum, maximum, instantaneous and demand values for the voltage regulator's load voltage, load current, real power, reactive power, and apparent power; the voltage regulator's instantaneous power factor; the voltage regulator's power factor at minimum and maximum apparent power; the voltage regulator's instantaneous minimum and maximum tap position; and a total operations count indicative of a number of tap changes occurring in the voltage regulator during the recurring time interval.

9. The method of claim 4 wherein step (b) comprises monitoring changes to the configuration data and wherein step (d) comprises capturing information indicative of the changes in the memory along with a time stamp indicative of when the changes were made.

10. The method of claim 4 comprising the further steps of determining when a new minimum or maximum value for at least one of the electrical parameters has occurred and storing information indicative of each of the new minimum or maximum values in the memory along with a time stamp indicative of when the new minimum or maximum value occurred.

11. A voltage regulator controller, coupled to a regulator transformer, comprising:

an operator interface, coupled to the voltage regulator controller, which receives operator selected configuration data selected by an operator of the voltage regulator controller;

a processor, coupled to the operator interface and to the regulator transformer, which monitors electrical parameters of the regulator transformer and provides control signals in response to the monitored parameters, and which further monitors log-triggering conditions specified by the operator selected configuration data; and a memory, coupled to the processor, which stores data, including at least some of the electrical parameters, in response to the log-triggering conditions specified by the operator selected configuration data, the log-triggering conditions including:

(a) occurrence of events relating to the control of the regulator transformer, wherein the data stored in the log memory also includes data indicative of the event; and (b) elapse of a recurring time interval.

12. The apparatus of claim 11 wherein at least one of the events is a tap change of the regulator transformer.

13. The apparatus of claim 11 wherein the data stored in the memory include minimum, maximum, instantaneous and demand values of the transformer's load voltage, load current, real power, reactive power, and apparent power; the transformer's instantaneous power factor; the transformer's power factor at minimum and maximum apparent power; the transformer's instantaneous minimum and maximum tap position; and a total operations count indicative of a number of transformer tap changes occurring during the recurring time interval.

14. The apparatus of claim 11 further comprising a real time clock coupled to the processor.

15. The apparatus of claim 14 wherein at least one of the log-triggering conditions specified by the operator selected configuration data is a change in the minimum and maximum values of at least some of the monitored electrical parameters.

16. The apparatus of claim 15 wherein the data stored in the memory is indicative of the change in minimum and maximum values of at least some of the monitored electrical parameters, and further wherein the data includes time and date data indicative of the time and date the change occurred.

17. The apparatus of claim 14 wherein at least one of the log-triggering conditions specified by the operator selected configuration data is an operator change of the configuration data.

18. The apparatus of claim 17 wherein the data stored in the memory is indicative of the change in the operator selected configuration data, and further wherein the data includes time and date data indicative of the time and date the change was made.

19. The apparatus of claim 11 further comprising a removable memory means coupled to the memory wherein the processor uploads the data stored in the memory to the removable memory means.

* * * * *